US005295193A

United States Patent [19]

Ono

[11] Patent Number: 5,295,193

[45] Date of Patent: Mar. 15, 1994

[54] DEVICE FOR PICKING UP BONE-CONDUCTED SOUND IN EXTERNAL AUDITORY MEATUS AND COMMUNICATION DEVICE USING THE SAME

[76] Inventor: Hiroshi Ono, No. 10-15, Koyama 7-chome, Shinagawa-ku, Tokyo, Japan

[21] Appl. No.: 824,104

[22] Filed: Jan. 22, 1992

[51] Int. Cl.[5] ..... H04R 25/00

[52] U.S. Cl. ..... 381/151; 381/68.3

[58] Field of Search ..... 381/151, 68.3, 68.7, 381/68.6, 188, 68, 183, 187

[56] References Cited

U.S. PATENT DOCUMENTS 3,529,102 9/1970 Rosenstand ..... 381/68.6

4,588,867 5/1986 Konomi ..... 381/151

FOREIGN PATENT DOCUMENTS 4-096599 3/1992 Japan ..... 381/151

*Primary Examiner*—Forester W. Isen

*Assistant Examiner*—Huyen D. Le

*Attorney, Agent, or Firm*—Wegner, Cantor, Mueller & Player

[57] ABSTRACT

A device for picking up bone-conducted sound in the external auditory meatus includes a fitting portion for accommodation in a navicular cavity formed between a tragus cartilage portion and an entrance portion of an external auditory meatus, and a bone conduction microphone unit for insertion into the external auditory meatus in such a manner as to be brought into contact with a wall of the external auditory meatus. The bone conduction microphone unit is held by the fitting portion via a resilient member in such a manner that at least a portion of the bone conduction microphone unit contacting the external auditory meatus is resiliently brought into contact with the wall of the external auditory meatus substantially orthogonally. Also disclosed is a communication device in which an earphone unit for transmitting sound from the outside is accommodated in the fitting portion of the device for picking up bone-conducted sound in the external auditory meatus, and a sound conductive tube of the earphone unit is open at a portion of the fitting portion facing the external auditory meatus.

3 Claims, 2 Drawing Sheets

DEVICE FOR PICKING UP BONE-CONDUCTED SOUND IN EXTERNAL AUDITORY MEATUS AND COMMUNICATION DEVICE USING THE SAME

BACKGROUND OF THE INVENTION

1. Field of the Invention

The present invention relates to a device for picking up bone-conducted sound in the external auditory meatus and a communication device using the same.

2. Description of the Related Art

Conventionally, in order to transmit speech in noisy places such as coal mining sites, quarrying sites, airports, construction sites, and sheet metal factories, a method in which a unidirectional microphone is used for the lips and a method in which an acceleration-type vibration pickup is used by being attached to the throat or the forehead have been adopted extensively. With the former unidirectional microphone, however, there are limitations in the elimination of external noise, and this method is therefore unsuitable for intensely noisy places. Meanwhile, in the latter case, since the vibration pickup needs to be closely secured to the throat or the forehead, there have been drawbacks in that the attachment thereof is complicated or troublesome, that the vibration pickup, when fitted, does not make a good appearance, and that a sensation of a foreign object being attached or discomfort in use felt by the user is so conspicuous that it cannot withstand a long time of use.

Accordingly, the present inventor has proposed in Japanese Patent Publication No. 39763/1978 a device for picking up bone-conducted sound vibrations from the wall of the external auditory meatus by disposing a vibration pickup in an earpiece forming a tubular casing for insertion into the external auditory meatus of the ear, the operating direction of the vibration pickup being substantially orthogonal to the direction of the external auditory meatus.

With the above-described pickup device, however, the earpiece constituting the tubular casing is difficult to be held stably unless it is inserted sufficiently deeply in the external auditory meatus. Therefore, if the earpiece is inserted sufficiently, the contact area and the contact pressure with respect to the external auditory meatus increase. This is favorable for the improvement of the function of the device, but the earpiece is applied too tightly in the external auditory meatus, so that a sensation of a foreign object being attached or discomfort is imparted to the user. In addition, the contact pressure becomes too high for some people, who come to have a sensation of pressure or a sensation of the external auditory meatus being blocked.

In addition, as another conventional device, a compact two-way communication device is known which incorporates an earphone unit in a portion thereof which is formed integrally with a tubular casing having a built-in microphone unit of the above-described type, so as to permit communication. With such a device, however, since the microphone unit and the earphone unit are formed integrally and are disposed in proximity to each other, there are cases where the sound pressure from the earphone unit is transmitted circuitously to the microphone unit. For the purpose of controlling the same, a method is adopted in which the earphone unit is surrounded by a sound absorbing material or a vibration absorbing material. However, if the external noise becomes large, the sound pressure in the earphone unit is inevitably increased, with the result that there has been the drawback that the circuitous transmission occurs and a howling is produced. Hence, this two-way communication device can be used only when the sound pressure in the earphone unit is set to a low level.

Air vibrations of sound from the earphone unit, external noise, and the like are, in principle, difficult to pick up by the vibration pickup-type external auditory meatus microphone, and the direction of air vibrations of external noise and the like and the direction of vibration of the external auditory meatus microphone unit are in an orthogonal relationship. Hence, the signal-to-noise (S/N) ratio of speech in the noise should naturally be high. This being the case, however, since the aforementioned microphone unit and the casing incorporating the earphone unit are formed integrally, the overall shape becomes large, and the vibration absorbing area increases, so that the external noise is picked up via the casing. Thus, there has been the drawback that although the vibration pickup type should exhibit an excellent anti-noise characteristic, the S/N ratio declines in a very noisy condition.

SUMMARY OF THE INVENTION

Accordingly, it is a primary object of the present invention to provide a device for picking up bone-conducted sound in the external auditory meatus, which is capable of securing a contact area and a contact pressure which are neither too large or too small with respect to the external auditory meatus without needing to insert an earpiece deeply into the external auditory meatus, and which is capable of holding a bone conduction microphone unit stably in a fitting portion.

A second object of the present invention is to provide a communication device which is provided with both an earphone unit and a microphone unit and which is capable of two-way communication and exhibits an excellent S/N ratio in a very noisy condition.

To attain the primary object of the invention, in accordance with a first aspect of the invention, there is provided a device for picking up bone-conducted sound in the external auditory meatus, comprising: a fitting portion for accommodation in a navicular cavity formed between a tragus cartilage portion and an entrance portion of an external auditory meatus; and a bone conduction microphone unit inserted into the external auditory meatus in such a manner as to be brought into contact with a wall of the external auditory meatus, wherein the bone conduction microphone unit is held by the fitting portion via a resilient member in such a manner that at least a portion of the bone conduction microphone unit contacting the external auditory meatus is resiliently brought into contact with the wall of the external auditory meatus substantially orthogonally.

To attain the second object of the invention, in accordance with a second aspect of the invention, there is provided a communication device incorporating therein the device according to the first aspect of the invention, wherein an earphone unit for transmitting sound from the outside is accommodated in the fitting portion of the device for picking up bone-conducted sound in the external auditory meatus, and a sound conductive tube of the earphone unit is open at a portion of the fitting portion facing the external auditory meatus.

In the first aspect of the invention, the fitting portion is first accommodated in the space of the navicular cavity in the ear, and is supported by an entrance portion of the external auditory meatus and a tragus cartilage portion. Meanwhile, when the microphone unit held in the fitting portion is inserted into the external auditory meatus up to an appropriate depth, the microphone unit is resiliently brought into contact with the wall surface of the external auditory meatus substantially orthogonally through the holding force of the resilient member, so as to facilitate the picking up of the vibrations in the external auditory meatus wall. This contact pressure is set to be a desirable value in view of the material, size, and the like of the aforementioned resilient member. As a result, an contact pressure which is neither too large or too small is imparted to the external auditory meatus wall of the user. It is acoustically preferred that the portion of the bone conduction microphone unit contacting the wall surface of the external auditory meatus be located at a distal end portion of the bone conduction microphone unit.

Thus, in the pickup device of this invention, the fitting portion and the bone conduction microphone unit are supported in contact with the navicular cavity and the external auditory meatus, respectively, and they are supported very stably at a plurality of positions in the three-dimensional space. Furthermore, the fitting portion is supported over a substantially large area of its outer periphery.

In the pickup device of the invention supported in the above-described manner, the bone conduction microphone unit in contact under an appropriate pressure picks up bone-conducted sound on the external auditory meatus wall. This picked-up sound signal is transmitted to the other receiving party by means of a transmitter incorporated in the pickup device or provided outside thereof.

In the second aspect of the invention, the fitting portion of the communication device is fitted to the external auditory meatus in the same manner as that of the pickup device in accordance with the first aspect of the invention, and the bone-conducted sound is picked up from the bone conduction microphone unit. Meanwhile, the sound from the other party is received as an electrical signal, and is converted to air-pressure vibrations in the earphone unit and is sent to the external auditory meatus via its sound conductive tube. Thus, two-way communication can be effected by the use of the bone conduction microphone unit and the earphone unit. At that time, since the bone conduction microphone unit is spaced apart from the fitting portion in which the earphone unit is accommodated, and is acoustically separated from it, the bone conduction microphone unit does not pick up the sound from the earphone unit. In addition, since the resilient member is interposed between the bone conduction microphone unit and the fitting portion, the external sound is prevented from being transmitted to the bone conduction microphone unit via the fitting portion.

DESCRIPTION OF THE PREFERRED EMBODIMENTS

Referring now to the accompanying drawings, a description will be given of the preferred embodiments of the present invention.

Figure 1:
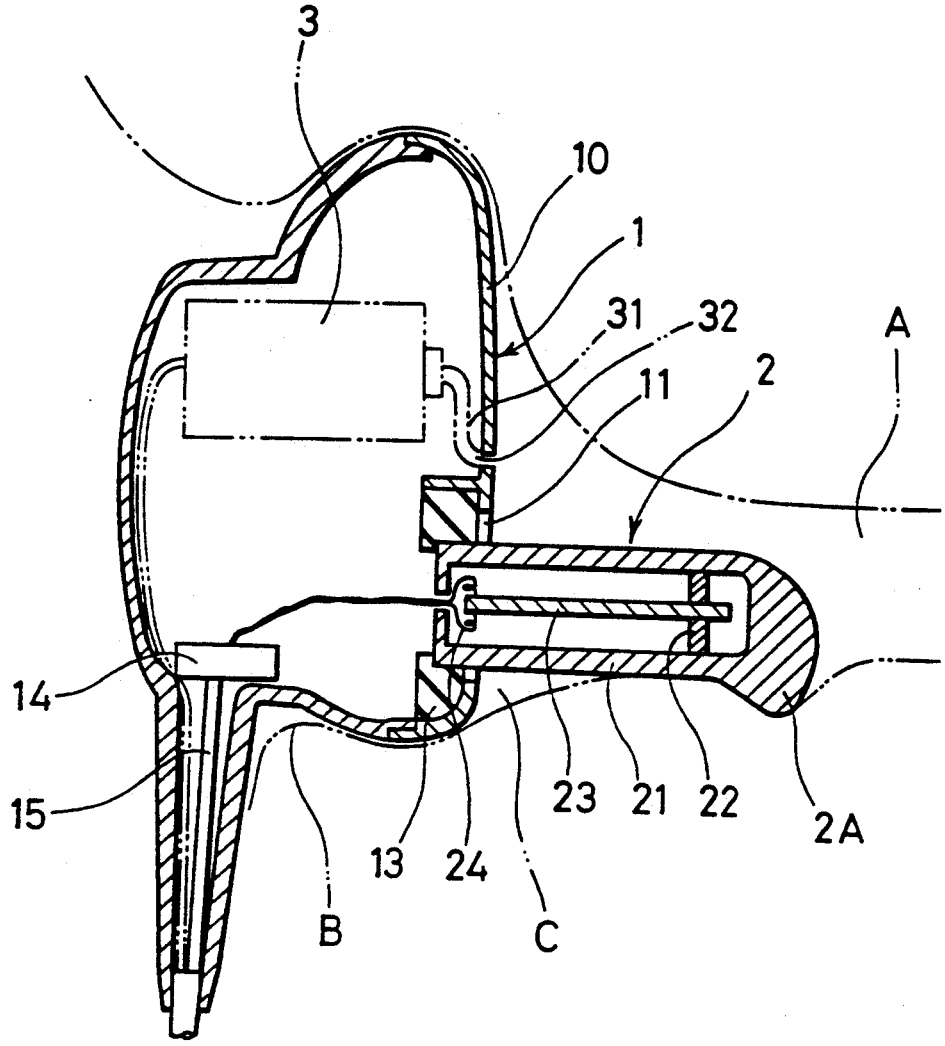
FIG. 1 is a cross-sectional view of a pickup device and a communication device in accordance with a first embodiment of the present invention.

FIG. 1 is a cross-sectional view of a pickup device in accordance with a first embodiment of the present invention. In FIG. 1, reference character A denotes the external auditory meatus, and B denotes a tragus cartilage portion. A hollow space C called a navicular cavity is formed in an intra-auricular surface between the external auditory meatus A and the tragus cartilage portion B.

The pickup device of the present invention comprises a fitting portion 1 and a bone conduction microphone unit 2. The fitting portion 1 has a substantially disk-shaped portion 10 whose frontal portion has a rounded cross section, and a hole portion 11 is formed therein at a position offset from the axis of the fitting portion 1. This fitting portion 1 is formed of a relatively hard material such as a plastic into a hollow configuration, and has a configuration and a size such that an outer peripheral surface of the disk-shaped portion 10 is just fitted in the space formed by the navicular cavity C.

A circuit portion 14, such as an impedance conversion circuit and the like, for transmitting an electrical signal received through the bone conduction microphone unit 2 to a transmitter (not shown) via a cable 15 so as to transmit the signal to the other receiving party, is incorporated in the inner space in the fitting portion 1. The transmitter is normally accommodated in the user's pocket or the like. It should be noted that when the receiving party is located in a near distance, it is possible to provide the circuit addition to the aforementioned impedance conversion circuit and the like, and to effect transmission to the receiving party directly from an antenna.

A vibration pickup element 23 of the bone conduction microphone unit 2 is supported in a tubular casing 21 by means of a holder 22 to which vibrations of the external auditory meatus are transmitted via a distal end portion 2A of the bone conduction microphone unit 2. Connected to the pickup 23 is a lead wire for transmitting the electrical signal of the pickup 23 caused by vibrations to the aforementioned circuit portion 14. The internal configuration of the bone conduction microphone unit 2 may be utterly the same as that of a conventional pickup device.

The tubular casing 21 of the bone conduction microphone unit 2 described above is held in such a manner that a proximal portion thereof is inserted in and secured to the aforementioned hole portion 11 via a resilient member 13. The tubular casing 21 is connected to the circuit portion 14 disposed in the fitting portion 1.

The material and size of this resilient member 13 is set in such a manner that the external sound collected by the fitting portion 1 will not be transmitted to the bone conduction microphone unit 2 through the disk-shaped portion 10 and that the distal end portion 2A of the bone conduction microphone unit 2 is resiliently brought into contact with microphone unit 2 is resiliently brought into contact with the external auditory meatus substantially orthogonally with respect to the wall surface of the external auditory meatus under an appropriate pressure.

The pickup device of this embodiment arranged as described above is used in the following manner.

First, the fitting portion 1 is inserted into the navicular cavity C, and the bone conduction microphone unit 2 is inserted into the space of the external auditory meatus A. As a result, the outer peripheral portion of the substantially disk-shaped fitting portion 1 is supported over an extensive range by the tragus cartilage portion B, an entrance portion of the external auditory meatus A, and the intra-auricular surface forming the navicular cavity C therebetween. Meanwhile, the bone conduction microphone unit 2 is placed in the space in the external auditory meatus A, and its distal end portion 2A is brought into contact with the wall of the external auditory meatus by means of the resilient member 13.

Thus the bone conduction microphone unit 2 is capable of securing a contact area and contact pressure sufficient for picking up the bone-conducted sound, and is held in a position in which the user does not feel a sensation of a foreign object being attached or a sensation of the external auditory meatus being blocked.

In such a condition, the sound uttered by the user is picked up by the bone conduction microphone unit 2 as the bone-conducted sound, and its electrical signal is transmitted from the transmitter to the receiver of the other party via the circuit portion 14. In this embodiment, when picking up the bone-conducted sound by means of the bone conduction microphone unit 2, even if the external sound is collected by the disk-shaped portion 10 in the fitting portion 1, since the resilient member 13 is interposed between the disk-shaped portion 10 and the bone conduction microphone unit 2, the external sound is not transmitted to the bone conduction microphone unit 2. In addition, since the bone conduction microphone unit 2 itself is formed separately from the disk-shaped portion 10 and is made compact, the surface area of the bone conduction microphone unit 2 is small, and is located inwardly. Hence, the bone conduction microphone unit 2 does not practically pick up the external sound.

In this embodiment, it is possible to dispose an earphone unit 3 in the disk-shaped portion 10 so as to arrange a communication device capable of transmission and reception in conjunction with the bone conduction microphone unit 2, as shown in FIG. 1. This earphone unit 3 itself may be a known one, and is adapted to issue sound through a sound conductive tube 31 by converting the signal received from the outside via the transmitter/receiver into air vibrations. The sound is transmitted to the external auditory meatus through an opening 32 provided in the fitting portion at a portion of the disk-shaped portion 10 facing the entrance of the external auditory meatus. In that case, since the earphone unit 3 is arranged by being spaced apart from the distal end portion 2A, which is a pickup portion of the bone conduction microphone unit 2, the so-called circuitous transmission of the sound from the earphone unit 3 to the bone conduction microphone unit 2 does not occur, nor are the vibrations of the earphone unit 3 transmitted to the bone conduction microphone unit 2 via the dish-shaped portion 10.

Figure 2:
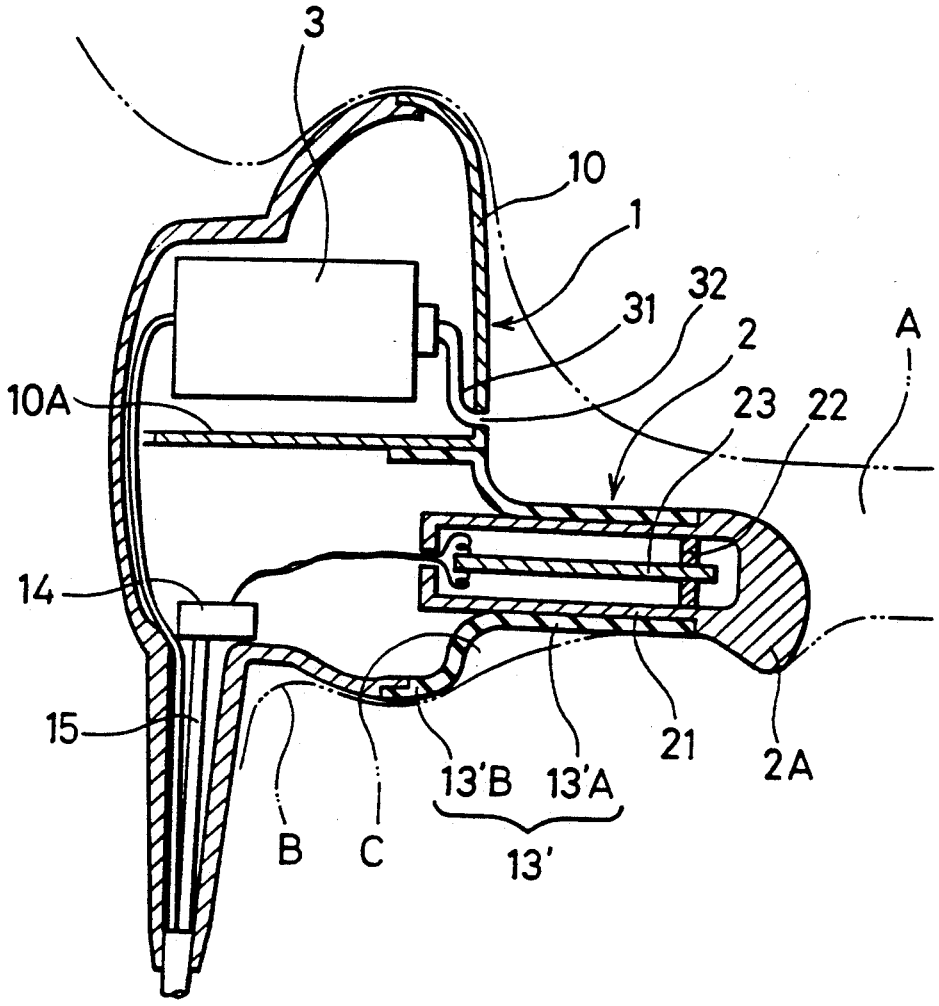
FIG. 2 is a cross-sectional view of the pickup device and the communication device in accordance with a second embodiment of the present invention.

Referring now to FIG. 2, a description will be given of a second embodiment of the present invention. Although in the foregoing embodiment the bone conduction microphone unit is held by the fitting portion by means of a block-like resilient member, this embodiment is characterized in that a major portion of the bone conduction microphone unit is covered with a tubular resilient member, and that the bone conduction microphone unit is held by the fitting portion via this resilient member. It should be noted that those portions identical with those of the first embodiment are denoted by the same reference numerals, and a description thereof will be omitted.

In FIG. 2, a resilient member 13' has a small diameter tubular portion 13'A and a proximal portion 13'B formed with a greater diameter than that of the tubular portion 13'A. The tubular portion 13'A is fitted over the tubular casing 21 of the bone conduction microphone unit 2 in such a manner as to cover a major portion of the tubular casing 21 excluding the distal end portion 2A thereof, and the proximal portion 13'B is affixed to the disk-shaped portion 10 of the fitting portion 1. By adopting this arrangement, in this embodiment the sound from the earphone unit 3 is prevented more reliably from being transmitted circuitously to the bone conduction microphone unit 2.

In addition, as a preferred form of this embodiment, the disk-shaped portion 10 is provided with a partition 10A disposed between the bone conduction microphone unit 2 and the earphone unit 3 to ensure that the sound from the earphone unit 3 is prevented far more reliably from being transmitted circuitously to the bone conduction microphone unit 2.

As described above, in accordance with the present invention, as for the pickup device, since the fitting portion is supported in the space formed in the navicular cavity, and the bone conduction microphone unit is supported by the wall of the external auditory meatus, the pickup device is supported in a three-dimensional manner, and is supported stably and reliably Furthermore, since the bone conduction microphone unit is held by the fitting portion via the resilient member, it is possible to readily obtain an appropriate pressure of contact with the external auditory meatus with a simple structure. In addition, even if the fitting portion picks up the external sound, the external sound is prevented from being transmitted to the bone conduction microphone unit, which can otherwise result in the so called howling phenomenon. On the other hand, if the earphone unit is accommodated in the fitting portion so as to arrange the two-way communication device, the vibrations of the earphone unit are prevented from being transmitted to the bone conduction microphone unit via the fitting portion by virtue of the aforementioned resilient member. In addition, since the bone conduction microphone unit can be disposed at a position spaced apart from the earphone unit, the sound pressure of the earphone unit is prevented from being transmitted circuitously to the bone conduction microphone unit.

What is claimed is:

1. A device for picking up bone-conducted sound in the external auditory meatus, comprising:

a fitting portion having an outer peripheral portion which is shaped and sized to be accommodated in use in a navicular cavity formed between a tragus cartilage portion and the entrance portion of the external auditory meatus, the outer peripheral portion in use contacting a wall of the navicular cavity to support the fitting portion in the navicular cavity;

a bone conduction microphone unit, having a contact portion which in use is brought into contact with a wall of the external auditory meatus for picking up bone-conducted sound; and a resilient member between the bone conduction microphone unit and the fitting portion, by which the fitting portion holds said bone conduction microphone unit, said resilient member in use resiliently applying a force to the contact portion of the microphone unit to urge the contact portion into contact with the wall of the external auditory meatus substantially orthogonally to said wall, the contact portion contacting said wall along an arc comprising less than the entire circumference of the external auditory meatus.

2. A device for picking up bone-conducted sound in the external auditory meatus according to claim 1, wherein a portion of said bone conduction microphone unit excluding the portion thereof contacting the wall of the external auditory meatus is at least partially covered with a resilient member.

3. A communication device incorporating therein the device according to claim 1, wherein an earphone unit for transmitting sound from the outside is accommodated in said fitting portion of said device for picking up bone-conducted sound in the external auditory meatus, and a sound conductive tube of said earphone unit is open at a portion of said fitting portion facing the external auditory meatus.

* * * * *